US007861471B2

(12) United States Patent
Smith

(10) Patent No.: US 7,861,471 B2
(45) Date of Patent: Jan. 4, 2011

(54) TRACK ASSEMBLY WITH APPARATUS FOR FORMING DECK EDGING FOR SWIMMING POOLS

(75) Inventor: Lanny R. Smith, Alpine, UT (US)

(73) Assignee: Coverstar, LLC, Lindon, UT (US)

( * ) Notice: Subject to any disclaimer, the term of this patent is extended or adjusted under 35 U.S.C. 154(b) by 789 days.

(21) Appl. No.: 10/290,548

(22) Filed: Nov. 8, 2002

(65) Prior Publication Data

US 2003/0084619 A1 May 8, 2003

Related U.S. Application Data

(60) Provisional application No. 60/347,260, filed on Nov. 8, 2001.

(51) Int. Cl.
*E04H 7/02* (2006.01)
*E04H 7/18* (2006.01)

(52) U.S. Cl. ..... 52/169.7; 4/498; 4/506

(58) Field of Classification Search ..... 52/102, 52/169.7, 169.8; 4/502, 498, 506, 510, 508, 4/488; 249/9, DIG. 3; 362/554, 565
See application file for complete search history.

(56) References Cited

U.S. PATENT DOCUMENTS 2,914,776 A * 12/1959 Hotz ..... 4/499
3,347,006 A * 10/1967 Fox ..... 52/300
3,416,165 A * 12/1968 Pereira ..... 52/169.7
3,427,663 A * 2/1969 O'Connell et al. ..... 52/716.2
3,444,659 A * 5/1969 Shanni ..... 52/149
3,512,326 A * 5/1970 Greene ..... 52/716.2
3,579,665 A * 5/1971 Barker ..... 52/169.7
3,584,319 A * 6/1971 Van den Broek ..... 52/169.7
3,673,751 A * 7/1972 Boassy et al. ..... 52/169.7
3,739,539 A * 6/1973 Posnick ..... 52/169.8
3,750,197 A * 8/1973 Weir et al. ..... 52/169.7
3,801,994 A * 4/1974 Brown ..... 4/499
3,811,236 A * 5/1974 Fiddes ..... 52/102
3,872,195 A * 3/1975 Stegmeier ..... 264/35
3,916,457 A * 11/1975 Morita ..... 4/502
3,938,199 A * 2/1976 Laven ..... 4/510
3,974,605 A * 8/1976 Beatty et al. ..... 52/481.1
3,975,874 A * 8/1976 Witte et al. ..... 52/169.7
3,986,310 A * 10/1976 van den Broek ..... 52/169.9
4,023,217 A * 5/1977 Kessler ..... 4/510
4,065,540 A * 12/1977 Okami ..... 264/278
4,077,173 A * 3/1978 Rozanski ..... 52/169.8
4,084,272 A * 4/1978 Laven ..... 4/510
4,118,809 A * 10/1978 Bertsch ..... 52/149

(Continued)

FOREIGN PATENT DOCUMENTS

FR 2577264 * 2/1985 ..... 4/498

(Continued)

*Primary Examiner*—Phi Dieu Tran A
(74) *Attorney, Agent, or Firm*—Holland & Hart LLP

(57) ABSTRACT

An apparatus is provided for constructing edging around the perimeter of a swimming pool having a decking and a retractable pool cover, wherein an elongated guide connector is attached to a wall of the swimming pool for connecting to a guide member for the pool cover, that includes a form member shaped to form the edging, and a form mating structure on the form member for removably mating the form member to the elongated guide connector.

29 Claims, 10 Drawing Sheets

U.S. PATENT DOCUMENTS

| | | | | | |
|---|---|---|---|---|---|
| 4,229,844 | A | * | 10/1980 | Cribben et al. | 52/716.2 |
| 4,318,254 | A | * | 3/1982 | Stegmeier | 52/169.7 |
| 4,335,474 | A | * | 6/1982 | Bailey | 4/506 |
| 4,457,119 | A | * | 7/1984 | Dahowski | 52/300 |
| 4,574,017 | A | * | 3/1986 | Stegmeier | 156/60 |
| 4,601,073 | A | * | 7/1986 | Methot | 4/506 |
| 4,603,521 | A | * | 8/1986 | Engelhart | 52/102 |
| 4,625,343 | A | * | 12/1986 | Bumgarner, Sr. | 4/506 |
| 4,713,849 | A | | 12/1987 | Kindness | |
| 4,735,395 | A | * | 4/1988 | Dahowski | 249/10 |
| 4,811,433 | A | * | 3/1989 | MacDonald et al. | 4/502 |
| 4,815,152 | A | * | 3/1989 | MacDonald et al. | 4/502 |
| 4,901,492 | A | * | 2/1990 | Coates | 52/300 |
| 4,939,798 | A | | 7/1990 | Last | |
| 4,967,424 | A | * | 11/1990 | Stegmeier | 4/496 |
| 4,974,266 | A | * | 12/1990 | Vultaggio et al. | 4/506 |
| 4,980,934 | A | * | 1/1991 | Dahowski et al. | 4/496 |
| 5,065,461 | A | | 11/1991 | Shehan et al. | |
| 5,107,551 | A | | 4/1992 | Weir et al. | |
| 5,134,819 | A | * | 8/1992 | Boyack | 52/169.7 |
| 5,170,517 | A | * | 12/1992 | Stegmeier | 4/496 |
| 5,239,709 | A | * | 8/1993 | Masotti | 4/503 |
| 5,282,282 | A | * | 2/1994 | Shehan et al. | 4/503 |
| 5,488,745 | A | * | 2/1996 | Barrera | 4/506 |
| 5,680,730 | A | * | 10/1997 | Epple | 52/28 |
| 6,026,522 | A | * | 2/2000 | Last | 4/502 |
| 6,133,838 | A | * | 10/2000 | Meniere | 340/573.6 |
| 6,418,572 | B1 | * | 7/2002 | Epple et al. | 4/502 |
| 6,457,189 | B1 | * | 10/2002 | Kindness | 4/506 |
| 6,725,469 | B2 | * | 4/2004 | Coates | 4/506 |

FOREIGN PATENT DOCUMENTS

| | | | | |
|---|---|---|---|---|
| GB | 2051572 | * | 5/1979 | 52/169.7 |
| GB | 2210785 | * | 6/1989 | 52/102 |
| GB | 2214799 | * | 9/1989 | 52/169.7 |
| JP | 25171 | * | 2/1991 | 4/502 |

* cited by examiner

TRACK ASSEMBLY WITH APPARATUS FOR FORMING DECK EDGING FOR SWIMMING POOLS

RELATED APPLICATION

This application claims the priority of provisional application No. 60/347,260, filed Nov. 8, 2001.

BACKGROUND

1. Field of Invention

The present disclosure relates to swimming pools, and, more particularly, to a track assembly with apparatus for forming deck edging for swimming pools.

2. Background

Swimming pools are commonly covered to prevent debris from entering the pool, to preserve chemical treatments in the water and to heat the pool in the case of a solar cover. An automatic pool cover provides convenience for a user by allowing the cover to be easily extended over the pool during periods of non-use, and retracted during periods of use. Typically, automatic pool covers utilize a track assembly built into the walls for guiding the leading edge bar of the cover as it traverses the pool. Such track assemblies are difficult to install and add clutter to the pool sides that may be unsightly and awkward to use.

In forming the coping and edging around the perimeter of pools it is useful to employ a mechanism in or attached to the pool walls that will provide uniformity in the coping and that can be easily installed and removed. Current forms are typically made of disposable materials, such as styrofoam, wood forms or other such materials. Such forms were often attached to the pool by two-sided tape or other temporary means. Often they were damaged during removal, so that new forms had to be used for each installation.

For pools with automatic vinyl covers, it is useful to have a mechanism in the pool walls that secures the bead of the vinyl liner to prevent wear and to maintain suitable appearance and structure. It is desirable that such a mechanism is simple, easy to install and firmly secures the edge or bead of the vinyl liner to the pool walls.

In addition, it is sometimes desirable to secure fiber optic lights or other decorative items in or around the pool walls. Using separate securing mechanisms for these purposes adds to the expense and installation time involved with pool construction.

Accordingly, a multiple purpose assembly for pool walls is needed that can perform one or more of the foregoing functions while minimizing the time and expense of installation. Such an assembly should be relatively simple and unobtrusive and should be flexible to accommodate various needs of different types of pool construction. Preferably, the assembly may include coping and edging forms that are easy to affix, provide uniformity in the forming function and are reusable to minimize cost.

SUMMARY

The present disclosure provides a multiple purpose encapsulation member that is able to carry out the functions described above. The encapsulation member includes an element for guiding a pool cover edge as it is retracted and extended. The member may further include an element for securing a form piece to be used in forming the edge of the pool decking. The form may be removably secured to the member, enabling it to be reused and for different forms to be utilized with a common encapsulation member. In addition, the member may provide an element for securing a bead on the end of a vinyl liner. Further the member has an element for securing fiber optic light tubing or other decorative elements.

In one implementation apparatus is provided for constructing edging around the perimeter of a swimming pool having a decking and a retractable pool cover wherein an elongated guide connector is attached to a wall of the swimming pool for mating to a guide member for the pool cover. The apparatus comprises a form member shaped to form the edging, and a form mating structure on the form member for removably mating the form member to the elongated guide connector. For purposes of this application, the term "mating" shall mean in contact, in an adjoining relationship, fit together, joined, or connected.

In another implementation, apparatus is provided for attaching to a wall of a swimming pool having a decking and a retractable pool cover, and disposed to accommodate a guide member for the edge of the pool cover as the cover extends and retracts. The apparatus comprises an elongated track member attached to the wall of the swimming pool to accommodate the guide member, and a form element for forming an edge of the decking for the pool, the form element being removably mated to the track member.

In another implementation, a method is provided for constructing edging around the perimeter of a swimming pool having a decking and a retractable pool cover, comprising connecting an elongated guide connector to a wall of the swimming pool, and removably mating to the elongated guide connector a form member shaped to form the edging.

BRIEF DESCRIPTION OF THE DRAWINGS

The above-mentioned and other features and advantages of this disclosure, and the manner of attaining them, will become more apparent and the disclosure will be better understood by reference to the following description of an implementation of the disclosure taken in conjunction with the accompanying drawings, wherein.

Corresponding reference characters indicate corresponding parts throughout the several views. The exemplification set out herein illustrates one implementation of the disclosure, in one form, and such exemplification is not to be construed as limiting the scope of the disclosure in any manner.

DETAILED DESCRIPTION

Figure 1:
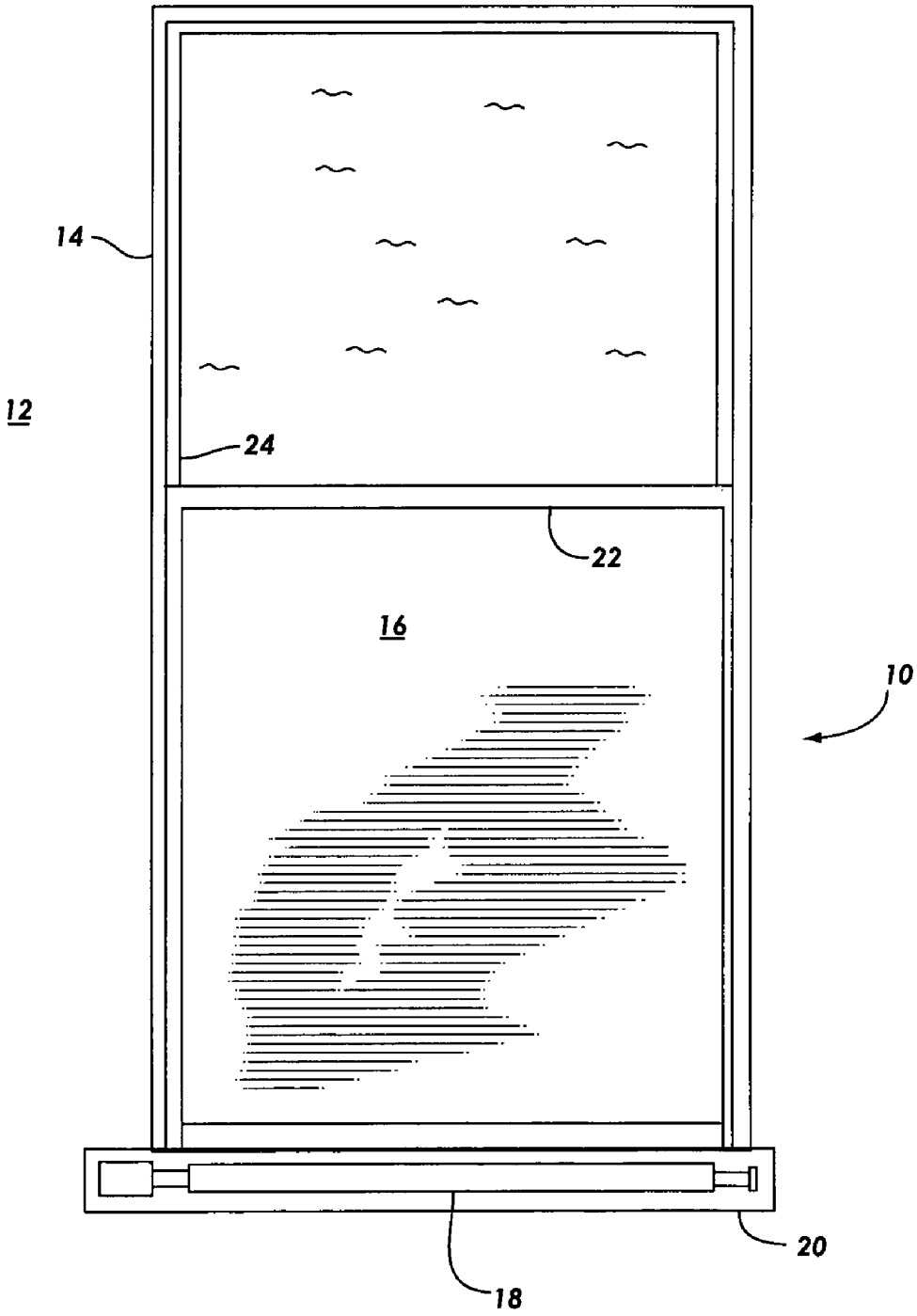
FIG. 1 is a plan view of a pool showing the location of the encapsulation assembly in the pool walls, according to the present disclosure.

Referring now to the drawings, and more particularly to FIG. 1, an implementation of a rectangular swimming pool 10 is shown having a pool deck 12 and walls 14 surrounding the pool. An automatic pool cover 16 extends from a pool cover mechanism 18 in a cover assembly box 20 disposed at one end of the pool 10. A leading edge bar 22 at the front edge of the pool cover 16 rides in a track encapsulation assembly 24 along the interior walls of the pool.

Deck 12 is generally horizontal and is preferably constructed from concrete. Coping 14 connects to deck 12 in a substantially coplanar fashion along the edge of deck 12 facing the interior of swimming pool 10. Encapsulation track assembly 24 may include structure to retain vinyl lining, coping forms and structure for fiber optic lighting running along the length of the pool.

Figure 2:
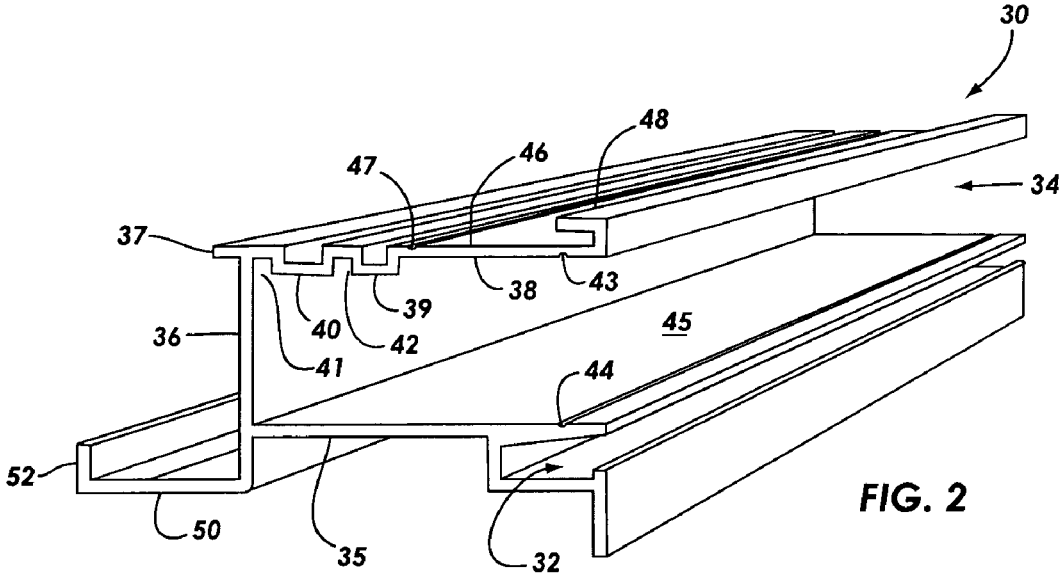
FIG. 2 is a perspective view of an implementation of a encapsulation extrusion, according to the present disclosure.

FIG. 2 shows an implementation of an encapsulation extrusion 30 according to the present disclosure. Extrusion 30 has an elongated slot 32 running along the bottom thereof to provide a cavity for securing the vinyl liner bead (not shown). A three-sided rectangular elongated cavity 34 formed by a bottom wall 35, a side wall 36 and a top wall 37, runs the length of extrusion 30 for receiving a cover guide extrusion, discussed below.

A bottom side 38 of top wall 37 includes protruding channels 39 and 40 that form grooves 41 and 42 for guiding the cover guide extrusion. Opposing elongated notches 43 and 44 are disposed in the bottom side 38 of top wall 37 and the top side 45 of bottom wall 35, respectively for securing a track cover, described below.

The top side 46 of top wall 37 includes an elongated lip 48 for securing a coping extrusion. Extending from the bottom of side wall 36 is an elongated L-shaped securing flange 50 running the length of the encapsulation extrusion. An elongated lip 52 extends from the end of flange 50 at approximately a right angle thereto. A small elongated groove (not shown) may be included to extend longitudinally along top side 46.

Figure 3:
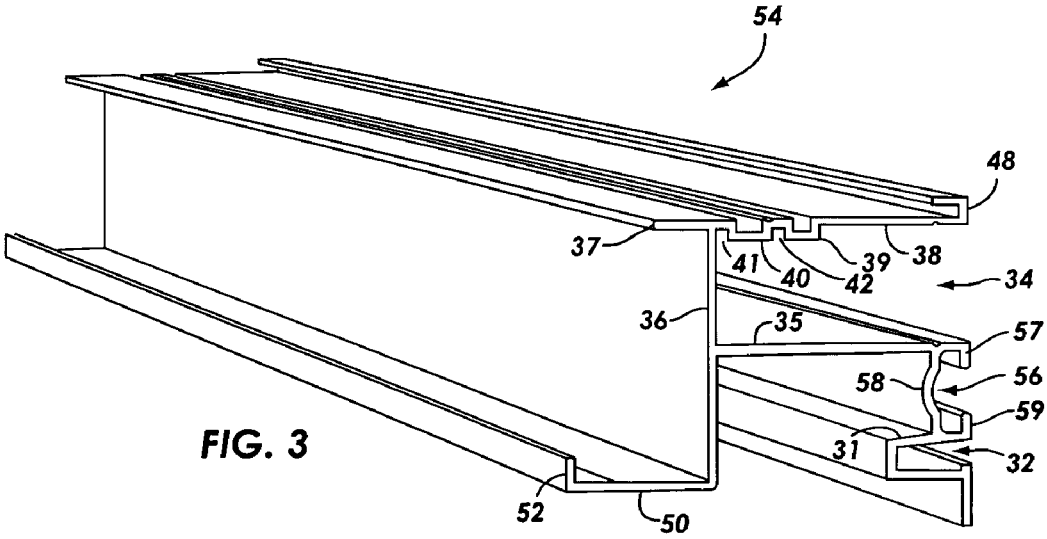
FIG. 3 is a perspective view of another implementation an encapsulation extrusion, according to the present disclosure.

Referring now to FIG. 3, an alternate implementation is shown of an encapsulation extrusion 54 that is essentially identical to the implementation shown in FIG. 2, except for the addition of an elongated cavity 56 for securing fiber optic lighting. Cavity 56 is formed by a side wall 58 extending vertically between the bottom wall 35 and a top wall 31 forming elongated slot 32. Wall 58 may be shaped as desired to accommodate the fiber optic tubing. Retaining lips 57 and 59 extend towards each other in the front of cavity 56 to retain the tubing.

Figure 4A:
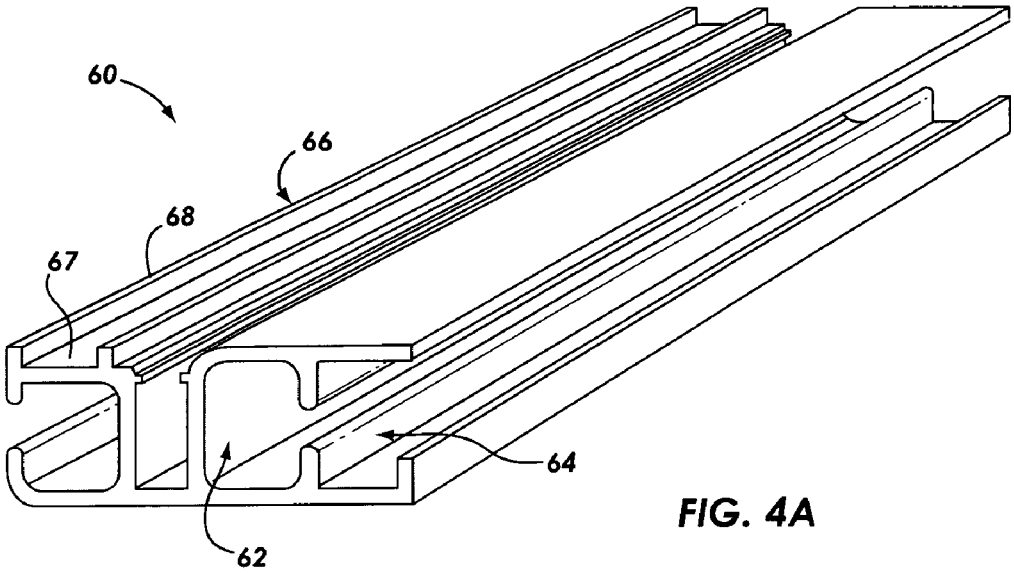
FIG. 4A is a perspective view of an implementation showing a cover guide extrusion according to the present disclosure.

FIG. 4A shows an implementation of a cover guide extrusion 60, sized and shaped to fit inside the cavity 34 of the encapsulation extrusions 30 illustrated in FIG. 2 or 54 illustrated in FIG. 3. An elongated cavity 62 is formed in the cover guide extrusion 60 having an open side 64 for receiving the edge of a pool cover (not shown). The top wall 66 of cover guide extrusion 60 is shaped with elongated channels 67 and protrusions 68 that are adapted to engage the grooves 41 and 42 and the protruding channels 39 and 40 respectively (depicted in FIGS. 2 and 3) so that the cover guide extrusion is mated in cavity 34 with the encapsulation extrusions 30 or 54.

Figure 4B:
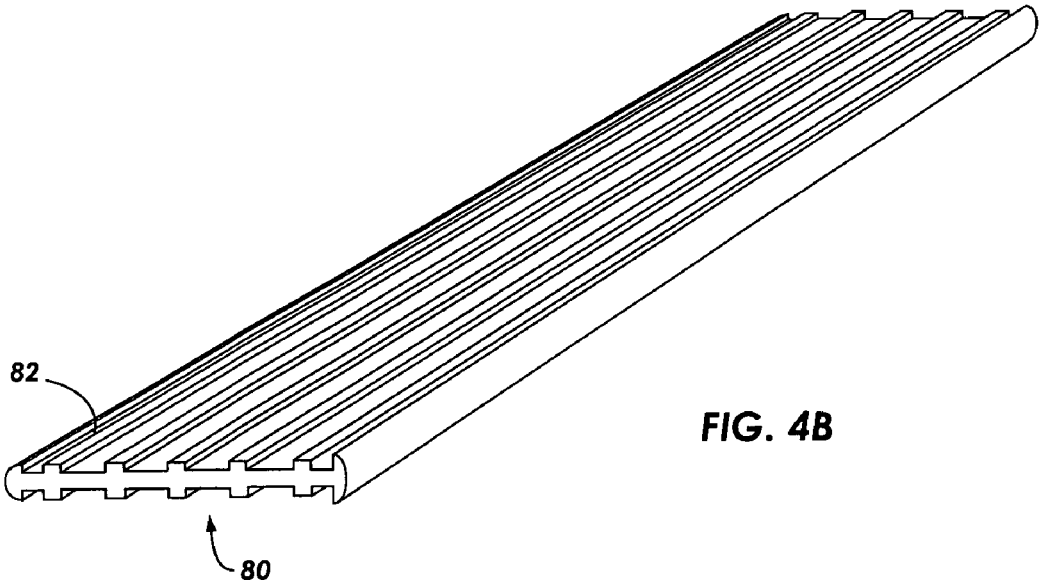
FIG. 4B is a perspective view of an implementation showing a guide support spacer extrusion according to the present disclosure.

FIG. 4B discloses a guide support spacer extrusion 80 for wedging into the cavity 34 of the encapsulation extrusion 30 above or below the cover guide extrusion 60, to secure extrusion 60 tightly in the cavity 34. Spacer extrusion 80 may include elongated protrusions 82 to provide additional security.

Figure 5:
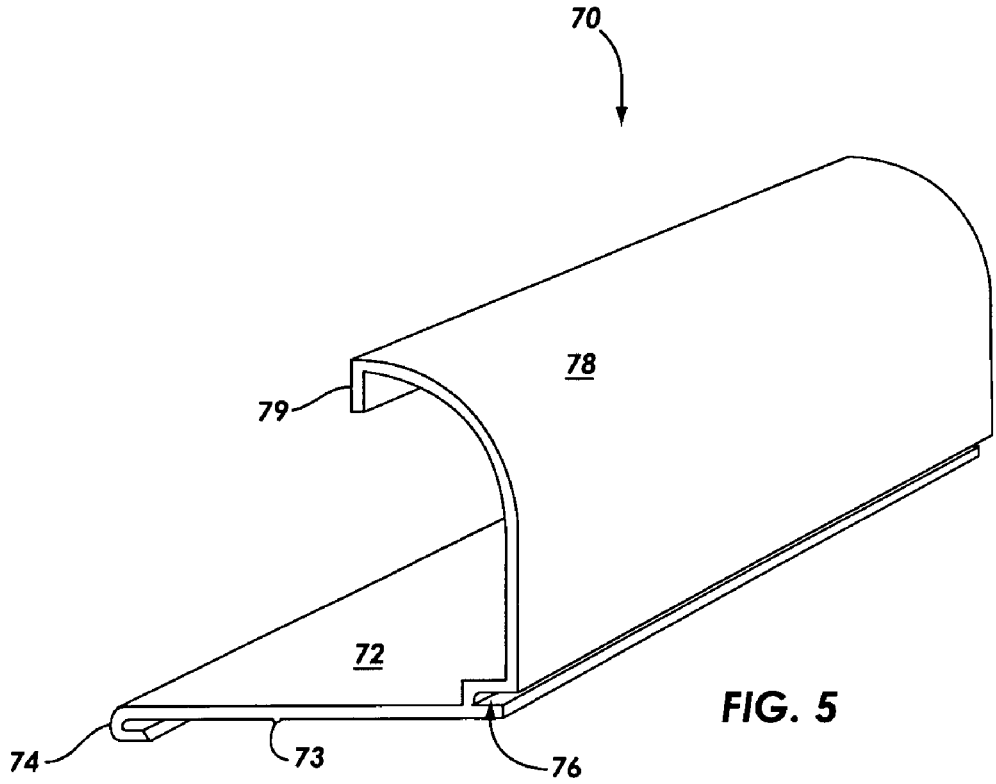
FIG. 5 is a perspective view of an implementation of a clip-on coping extrusion, according to the present disclosure.

FIG. 5 discloses an elongated clip-on coping extrusion 70 for mating to the top wall 37 of the encapsulation extrusion 30. Extrusion 70 includes a flat member 72 having a lip 74 at one end and a slot 76 at the other end. A curved elongated member 78 is shaped to form the pool coping (not shown). Member 78 may be formed in any shape to provide the appearance desired for the coping. A lip 79 extends downward to secure the coping extrusion 70 to the top of encapsulation extrusions 30 or 54, shown in FIGS. 2 and 3. A snap hook extrusion 73 extends longitudinally along the undersurface of member 72 for further securing the coping extrusion 70, as disclosed below. Looking now at FIG. 6, the elements separately shown in FIGS. 3-5 are shown functional connection with each other to form an encapsulation assembly 84. Coping extrusion 70 is mated to encapsulation extrusion 54 by sliding lip 48 into slot 76 and by sliding lip 74 onto the end of top wall 37, as shown. Coping extrusion 70 is further secured by mating snap hook extrusion 73 into groove 47. Cover guide extrusion 60 is wedged in cavity 34 of encapsulation extrusion 54 by spacer extrusion 80. A fiber optic tube 86 is secured in cavity 56.

Figure 7:
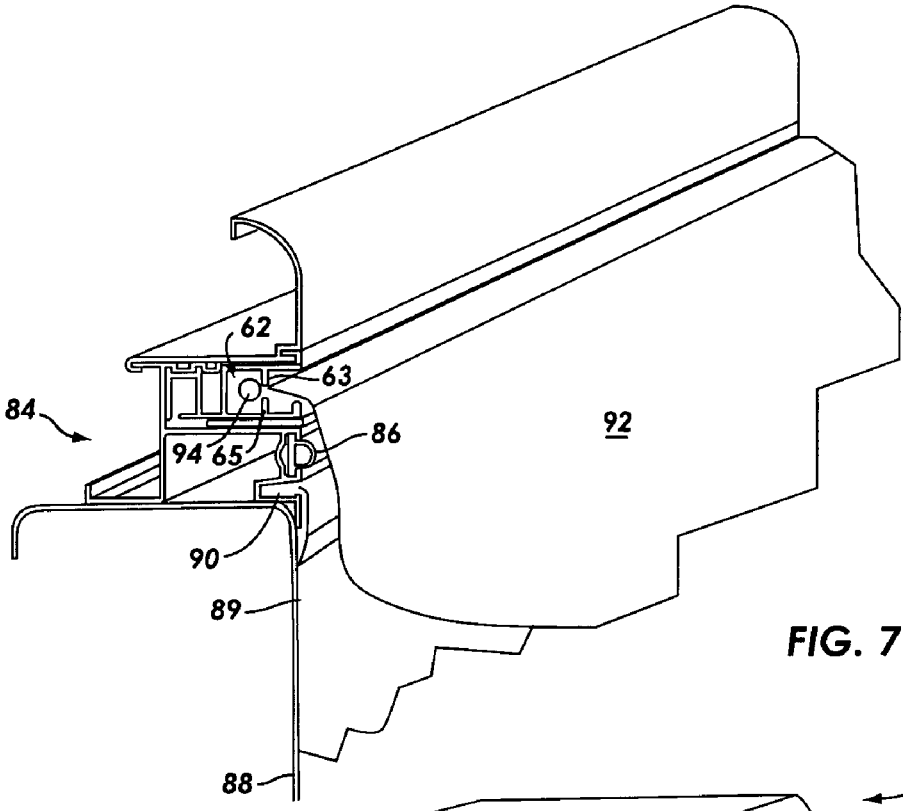
FIG. 7 is a perspective view of the implementation of FIG. 6 showing a vinyl liner and a pool cover, according to the present disclosure.

FIG. 7 shows the same assembly 84 including a vinyl liner 89 in contact with a side wall 88 and having a beaded edge 90 secured within cavity 62 of the encapsulation extrusion 30. A pool cover 92 is secured to assembly 84 by an elongated tubing 94 connected to the edge of cover 92 and secured in cavity 62. Preferably tubing 94 is smaller than the dimensions of the cavity 62 so that it can move freely along the cavity 62 as the pool cover is extended or retracted. Lips 63 and 65 at the front of cavity 62 retain tubing 94 in cavity 62. Support spacer extrusion 80 is pushed into the cavity 34 below the cover guide extrusion 60.

Figure 8:
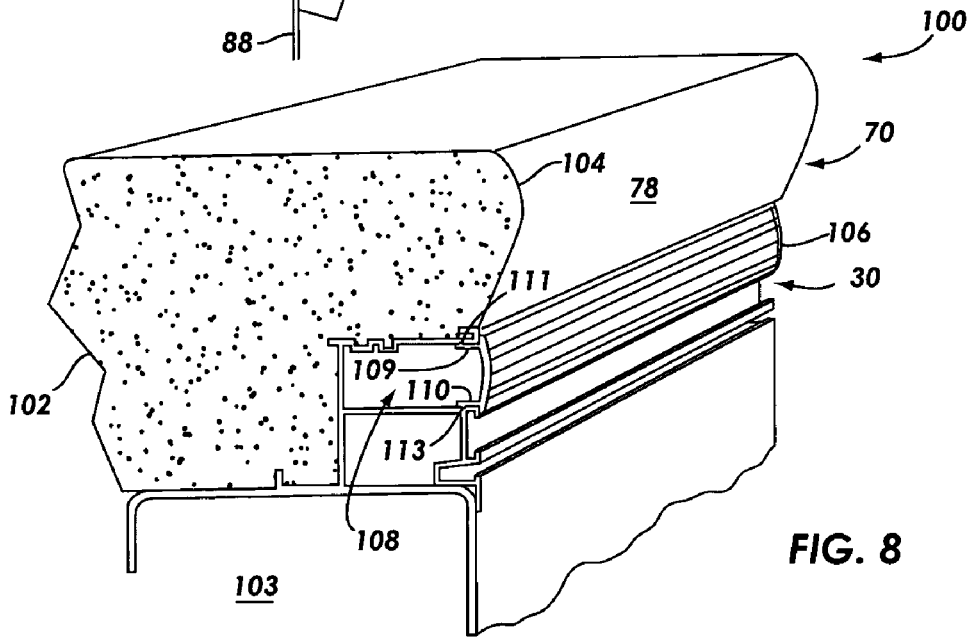
FIG. 8 is a perspective view of the implementation of FIG. 6 showing a portion of a deck and a guide cover, according to the present disclosure.

FIG. 8 shows another implementation of an encapsulation assembly 100 in which the encapsulated extrusion 30 of FIG. 2 is mated with the coping extrusion 70 of FIG. 5. Assembly 100 is embedded in an edge of a pool deck 102. Curved coping member 78 shapes the edge of the pool deck 104 to the configuration of member 78.

Figure 9:
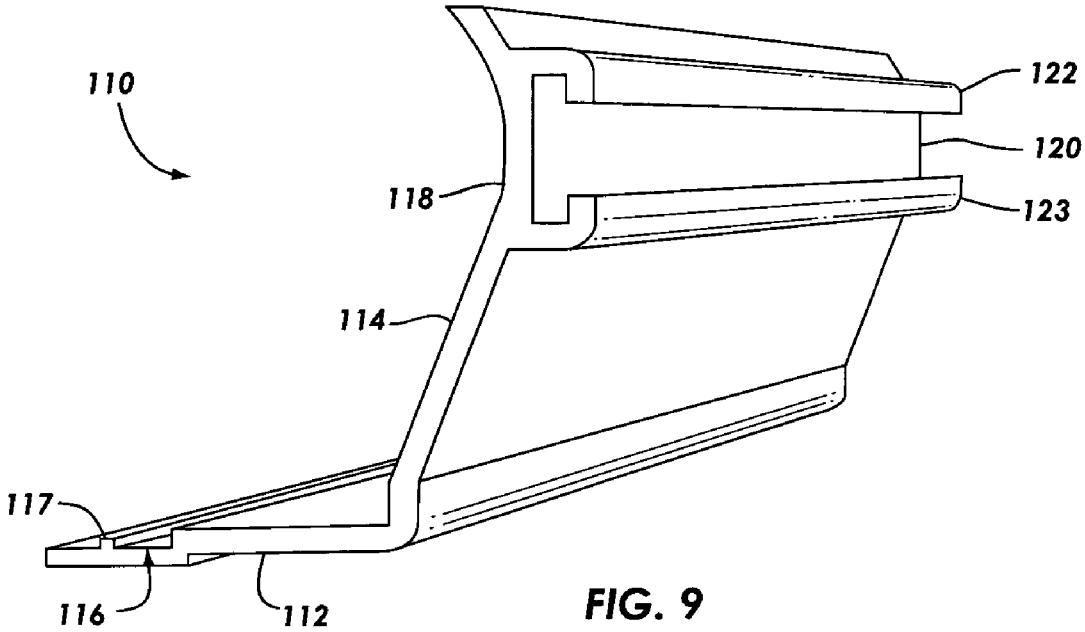
FIG. 9 is a perspective view of an implementation of a concrete form extrusion, according to the present disclosure.

In this implementation, a cover guide is not used, either because a pool cover is not deployed or because the encapsulation assembly is disposed on a back wall of the pool where a pool cover guide extrusion is not needed. In such instances, cavity 108 may be capped by a cover 106 for cosmetic and safety purposes. Cover 106 is secured by small flanges 109 and 110 that extend into cavity 108. Tiny lips 11 land 113 at the end of flanges 109 and 110 mate with corresponding grooves, such as grooves 43 and 44 as shown in FIG. 2. Looking now at FIG. 9, a concrete form 110 is shown that can be attached to the encapsulation extrusions 30 or 54, shown in FIGS. 2 and 3. Form 110 is a generally L-shaped member having a bottom wall 112 and a side wall 114. Bottom wall 112 includes channel 116 and protrusion 117 that are formed to mate with corresponding protrusion 39 and channel 42 in the bottom side 38 of top wall 37, as shown in FIG. 3. Side wall 114 has a curvature 118 designed to shape the edge of the concrete decking of the pool. A channel 120 is formed along the back side of wall 114 for holding an alignment piece for aligning form 116 with adjacent form members. Opposing lip members 122 and 123 are formed to retain the alignment piece.

Figure 10:
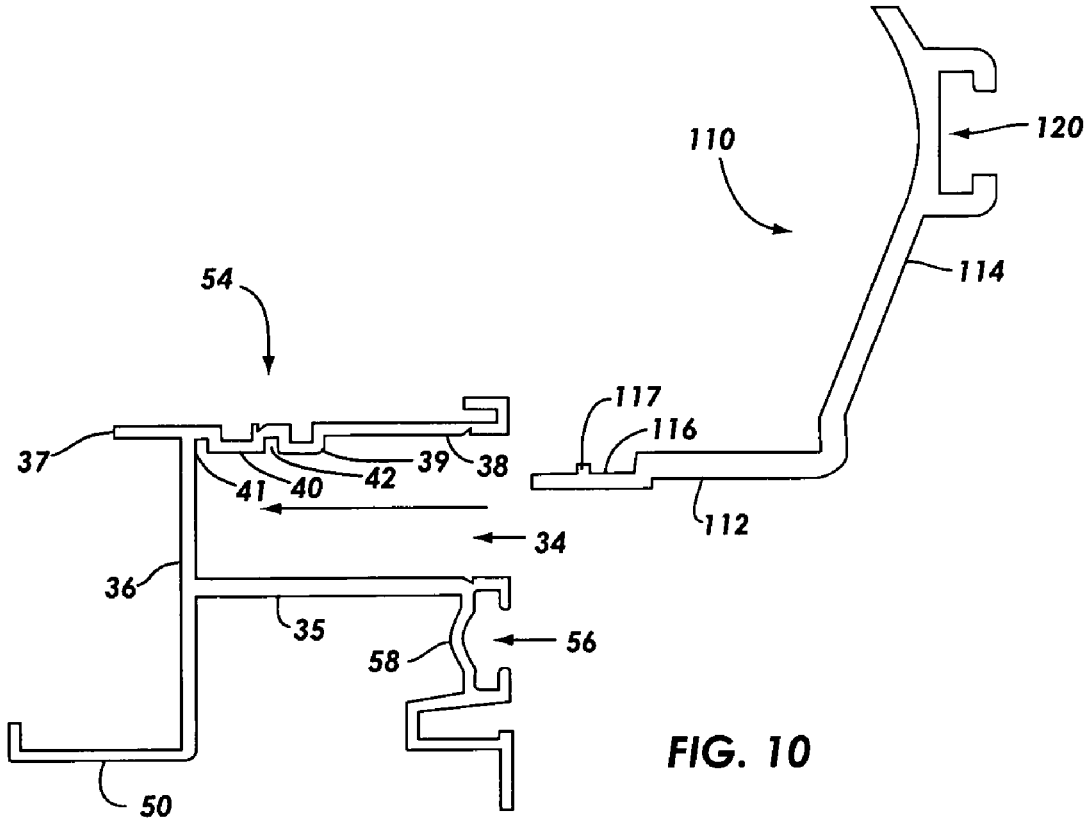
FIG. 10 is a side view of the implementation of FIG. 9, in mating position with the encapsulation extrusion of FIG. 3, according to the present disclosure.

FIG. 10 shows the manner in which the concrete form 110 mates to the encapsulation extrusion 54. Bottom wall 112 extends into the cavity 34 of extrusion 54 so that channel 116 and protrusion 117 mate with the corresponding protrusion 39 and channel 42 of the bottom part 38 of top wall 37 of extrusion 54.

Figure 6:
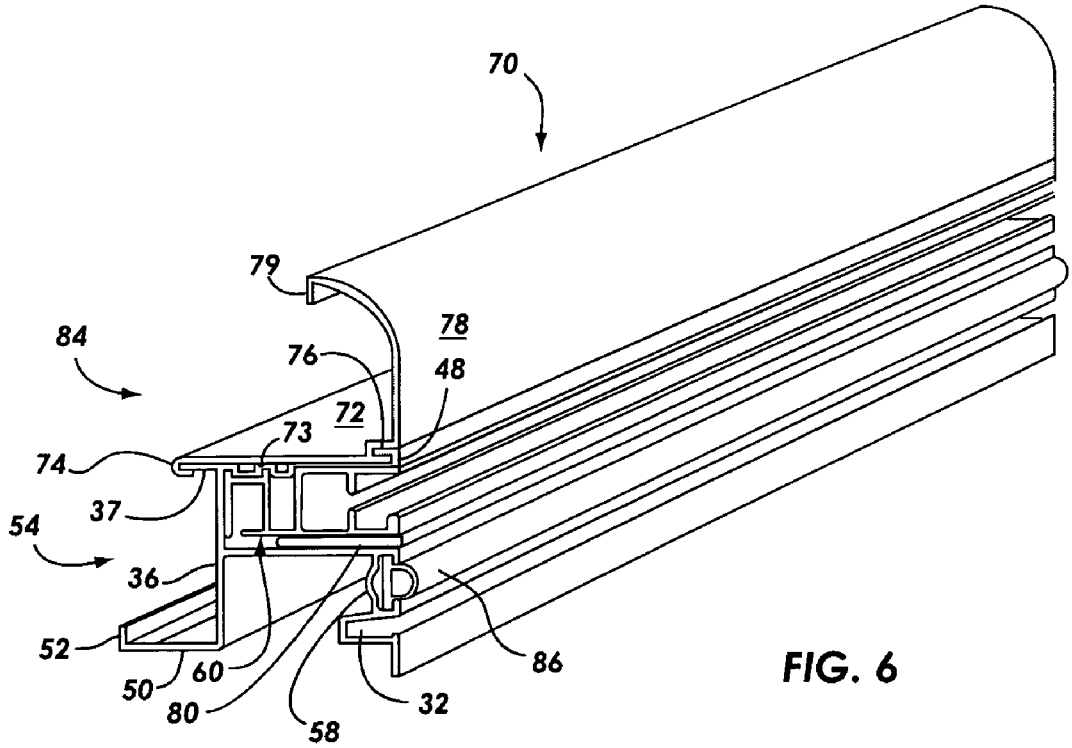
FIG. 6 is a perspective view of one implementation of the encapsulation assembly, according to the present disclosure.
Figure 11:
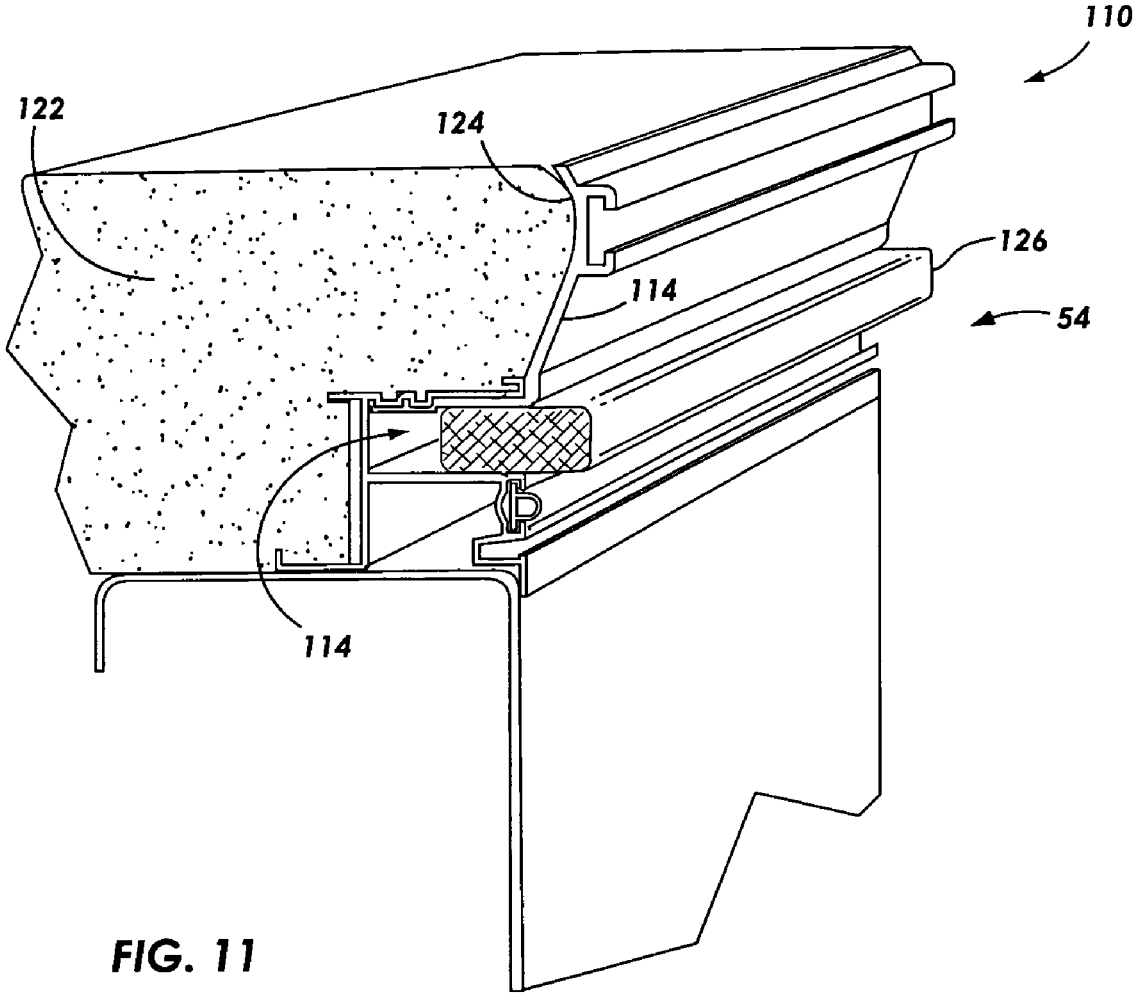
FIG. 11 is a perspective view of the implementation of FIG. 10 showing the deck and other members, according to the present disclosure.

FIG. 11 shows the concrete form 110 and encapsulation extrusion 54 completely mated. A concrete deck 122 is formed adjacent thereto, with the shape of side wall 114 of form 110 determining the curvature of the deck edging 124. A spacer 126 is inserted into cavity 34 of encapsulation extrusion 54 to maintain the shape of the cavity during formation of the deck. Spacer 126 may be of any shape and material sufficient to maintain concrete form 110 snugly abutting the lower surface of encapsulation extrusion 54. After the deck is formed, concrete form 110 is removed from cavity 34, together with filler piece 126 so that the pool cover guide extrusion 60 can be inserted, as shown in FIG. 6.

Figure 12:
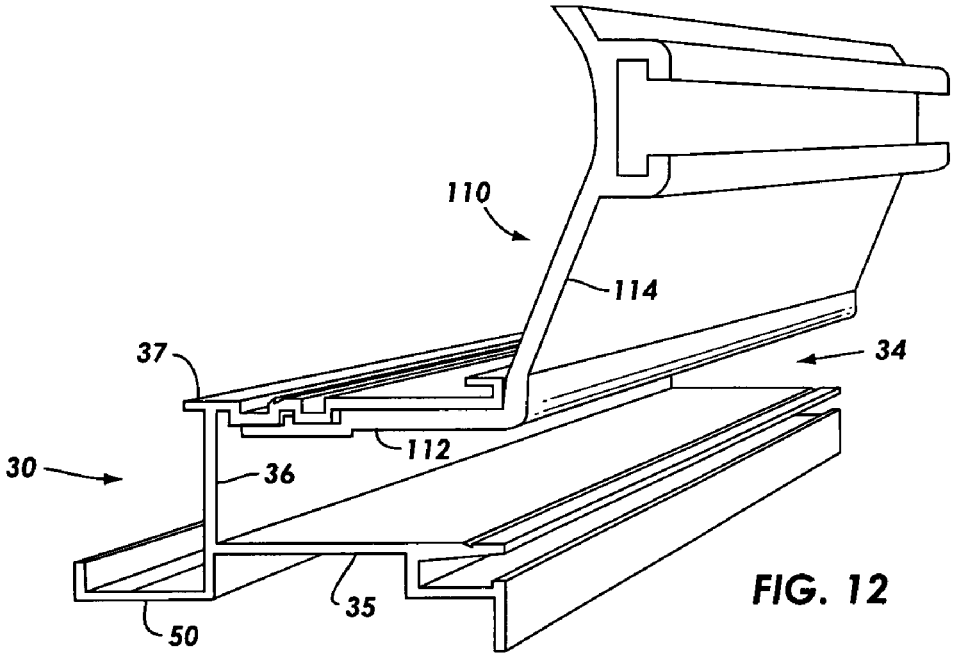
FIG. 12 is a perspective view of the implementation of FIG. 9, alternately mated with the encapsulation extrusion of FIG. 2, according to the present disclosure.

FIG. 12 show concrete form 110 mated with the encapsulation extrusion 30 shown in FIG. 2. FIGS. 11 and 12 together make it apparent that concrete form 110 will readily mate with both of the encapsulation extrusions 30 and 54 shown in FIGS. 2 and 3.

Figure 13:
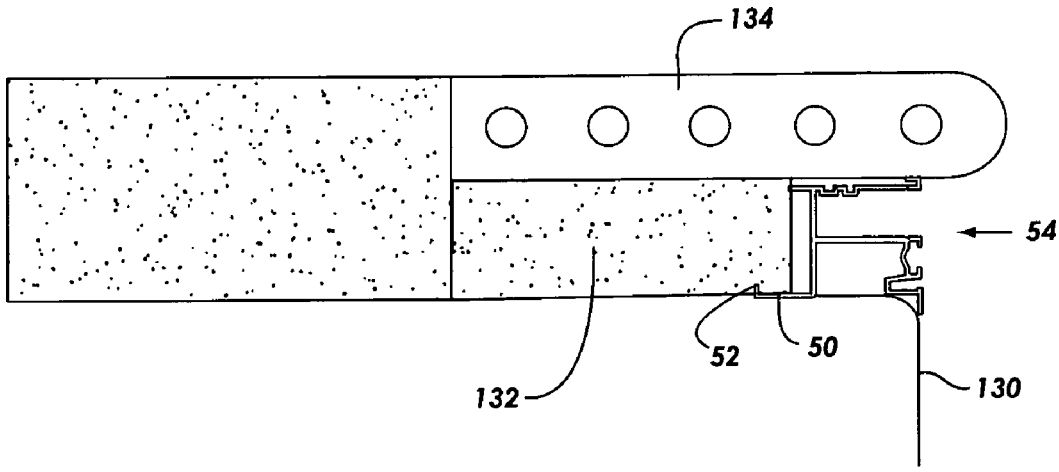
FIG. 13 is a side view of the implementation of FIG. 3 showing the encapsulation extrusion disposed in a pool wall with masonry, according to the present disclosure.

FIG. 13 shows the encapsulation extrusion 54 of FIG. 3 inset on the top of a pool wall 130. Flange 50 and lip 52 extend into the mortar 132 above the wall 130 to secure the extrusion 54. In this arrangement, masonry 134 is formed above extrusion 54 made of any appropriate material, such as brick, in any desirable shape to form an edge to the pool. In this situation, concrete form 110 or coping form 70 would not be required.

Figure 14:
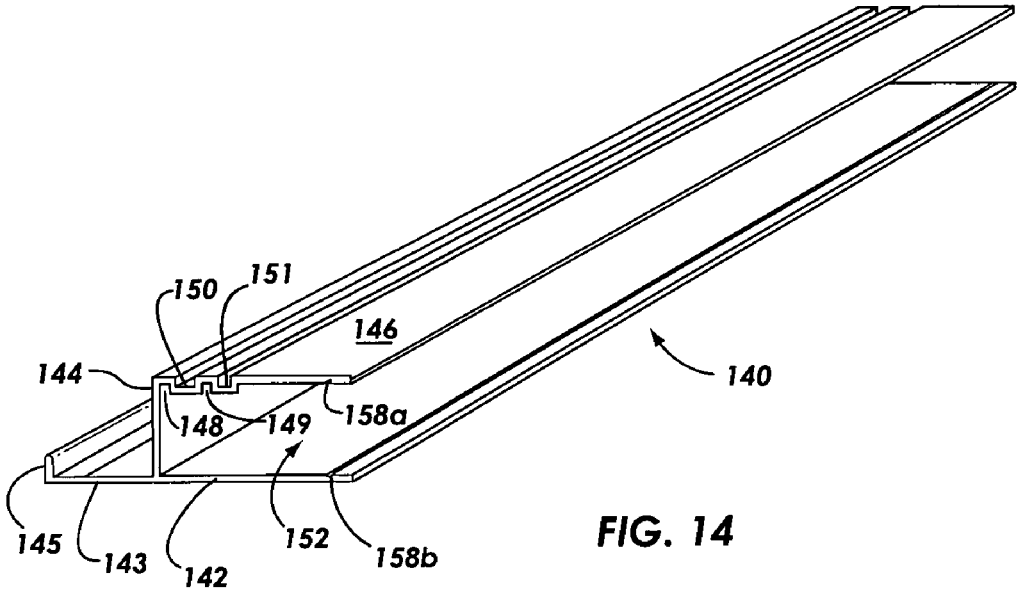
FIG. 14 is a perspective view of another implementation showing an encapsulation extrusion for concrete pool walls, according to the present disclosure.

FIG. 14 shows an encapsulation extrusion 140 for use with gunite concrete pools rather than vinyl lined pools. In this implementation of the encapsulation extrusion no vinyl bead retention slot 32 or fiber optic cavity 56 are needed, as shown in the implementation of FIG. 3. Extrusion 140 has a bottom wall 142, a side wall 144 and a top wall 146 which form a cavity 152, similar to the shape of the other encapsulation extrusions shown in FIGS. 2 and 3. Also, a flange 143 with lip 145 extends from the intersection of bottom wall 142 and side wall 144, for securing the encapsulation extrusion 140 in an appropriate medium, such as mortar.

Figure 15:
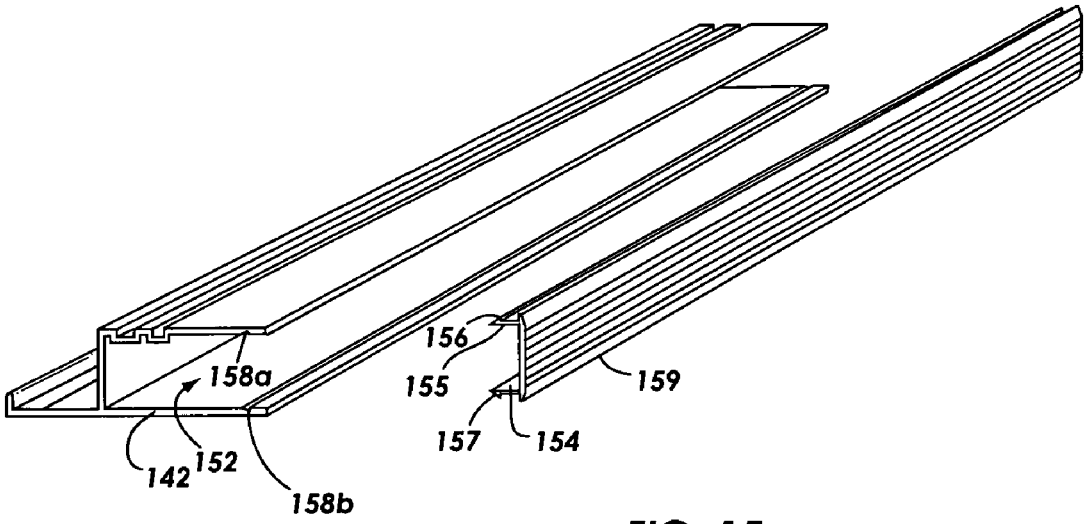
FIG. 15 is a perspective view showing a cover for the encapsulation extrusion implementation shown in FIG. 14.

FIG. 14 includes channels 148, 149 and protrusions 150, 151 to mate with the cover guide extrusion 60 shown in FIG. 4A. When the cover guide extrusion 60 is not used, such as in the absence of a pool cover or along the wall of the pool opposite the pool cover assembly, an encapsulation gap cover 159 can be applied to cover cavity 152, as shown in FIG. 15. This arrangement is similar to the members shown in FIG. 8. Cover 159 includes flanges 154 and 155 each having tiny lips 156 and 157 that are designed to snap into elongated grooves 158*a,b*.

Figure 16:
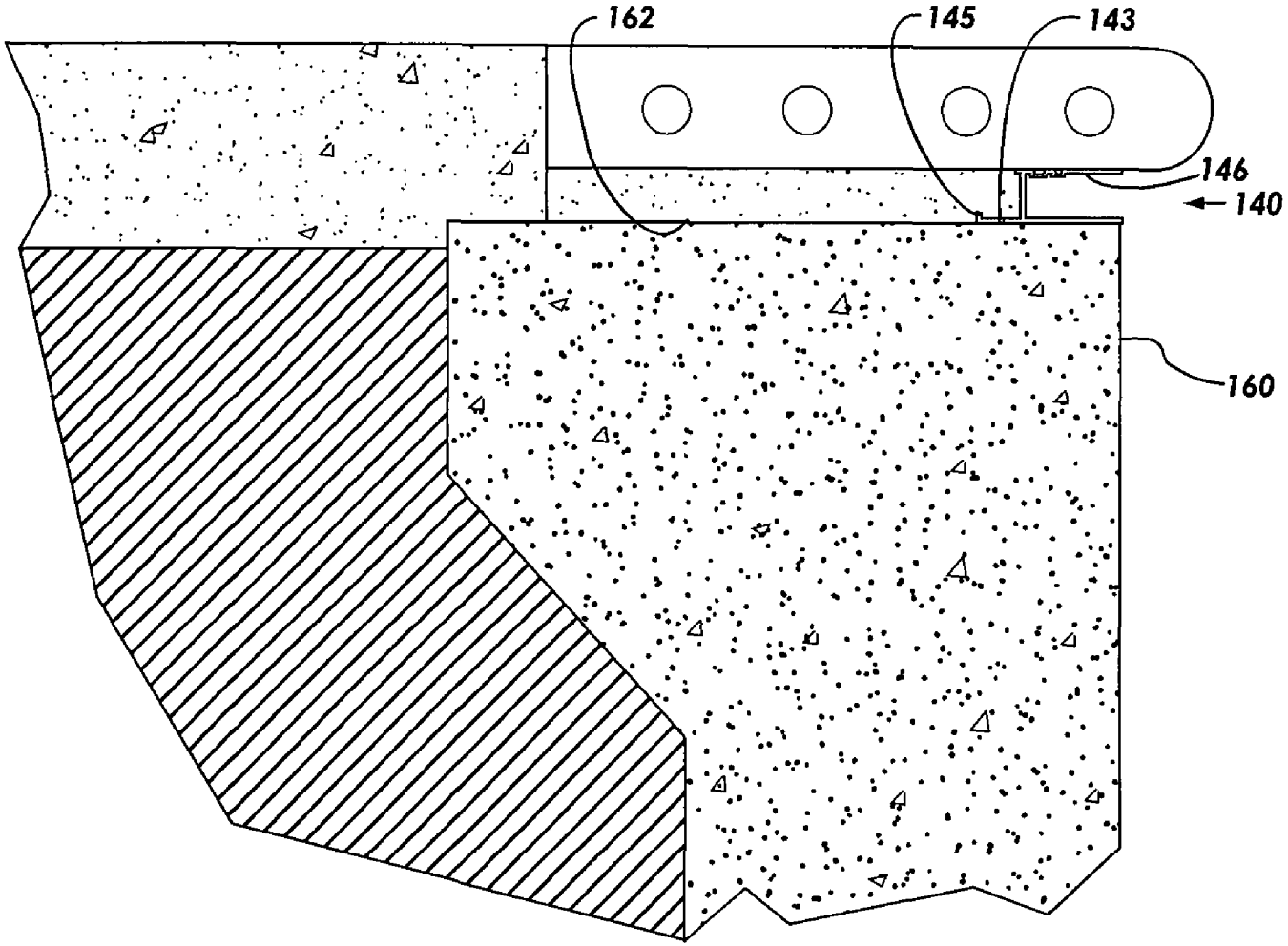
FIG. 16 is a side view of the implementation of FIG. 14 showing the encapsulation extrusion disposed in a pool wall with masonry, according to the present disclosure.

FIG. 16 discloses the encapsulation extrusion 140 shown in FIG. 14 inset on the top of a pool wall 160, similar to the implementation shown in FIG. 13. Flange 143 and lip 145 extend into mortar 162 to secure the extrusion 140. Masonry 164 of any appropriate design and shape rest on top of the top wall 146 of extrusion 140.

As can be seen, the encapsulated track assembly of the present disclosure can take several different shapes, depending on the type of pool and the functions required, including securing the vinyl liner, holding fiber optic lighting, positioning form extrusions to form deck coping or edging and guiding pool cover edge members as the cover is retracted and extended. This This multiple purpose system is simple, easy to construct and install and relatively inexpensive.

The encapsulated track assembly provides a simple means to insert a form for the decking into the assembly and then remove it for future use after the decking is formed. The concrete forms are reusable and are readily mated with the encapsulation assembly. Numerous additional advantages are apparent from the disclosure provided herein.

Although the above implementations are representative of the present disclosure, other implementations will be apparent to those skilled in the art from a consideration of this specification and the appended claims, or from a practice of the implementations of the disclosed disclosure. It is intended that the specification and implementations therein be considered as exemplary only, with the present disclosure being defined by the claims and their equivalents.

What is claimed is:

1. An apparatus for constructing edging of a swimming pool, comprising:

(a) an elongated guide connector configured to be permanently embedded in a wall of the swimming pool and having an open-sided cavity defined therein that is configured to receive a pool cover guide member, said cavity having a top portion and a bottom portion, a bottom side of the top portion having a form-receiving structure formed thereon, (b) a unitary metallic deck forming member having an edge forming portion shaped to form the edging, and (c) a metallic form mating structure integrally formed on a top portion of said unitary deck forming member for removably mating said unitary deck forming member to said elongated guide connector, wherein said form mating structure is adapted to be mated to said form receiving structure.

2. The apparatus of claim 1 wherein said unitary deck forming member is configured to be coupled to said elongated guide connector so that said unitary deck forming member and said elongated guide connector may be decoupled after the edging is fanned.

3. The apparatus of claim 1, wherein the form member may be mated to the elongated guide connector so as to be permanently affixed thereto after the edging is formed.

4. The apparatus of claim 1, wherein said unitary deck forming member includes a planar member having said form mating structure thereon, said planar member being formed to abut with said elongated guide connector.

5. The apparatus of claim 4, wherein said planar member is configured to abut directly with said elongated guide connector, without a separate element disposed between said planar member and said elongated guide connector.

6. The apparatus of claim 4, wherein said form mating structure is disposed on a top portion of said planar member, said form mating structure including a protrusion formed on said top portion, wherein the bottom side of said top portion of said elongated cavity has a channel formed therein, said channel being sized to receive said protrusion.

7. The apparatus of claim 1, wherein said unitary deck fanning member includes a protrusion adapted to extend into said open-sided cavity to be removably coupled to said elongated guide connector within said open-sided elongated cavity.

8. An apparatus for attaching to a wall of a swimming pool, comprising:

(a) an elongated track member permanently secured to a wall of the swimming pool, said elongated track member having top and bottom members forming an open-sided cavity therebetween, the bottom side of said top member having a channel defined therein for receiving a pool cover guide member; and (b) a unitary form element for forming an edge of decking for the pool, said unitary form element including an edge forming portion shaped to form the edging, and a connector for connecting said unitary form element to said elongated track member.

9. The: apparatus of claim 8, wherein said unitary form element is coupled to said elongated track member so as to be removed after the pool decking is formed.

10. The apparatus of claim 8, wherein the form element is mated to the track member so as to be permanently affixed thereto after the pool decking is formed.

11. The apparatus of claim 8 and further comprising a removable spacer element for securing said unitary form element to said elongated track member while the edge of the decking is being formed.

12. The apparatus of claim 8, and further comprising a bead-securing element for containing the end bead of a vinyl pool liner.

13. The apparatus of claim 8, and further comprising a fiber optic element for containing light tubing for the pool.

14. An apparatus for attaching to a wan of a swimming pool, and disposed to accommodate a guide member for the edge of a pool cover as the pool cover extends and retracts, comprising:

(a) an elongated track member permanently attached to a wall of the swimming pool, said elongated track member having an elongated cavity defined therein for accommodating the guide member, (b) an elongated surface on said elongated track member, said elongated surface having a first mating element formed on a bottom side of a top portion of said elongated track member;

(c) it reusable unitary metallic form member for forming an edge of the decking, said unitary form member having an integral second mating element conforming to the shape of said first mating element; and (d) a securing member for securing said unitary form member to said elongated surface so that said first and second mating elements register together.

15. The apparatus of claim 14, wherein said first mating element is on an underside of said elongated surface and said second mating element is on a unitary form member surface that registers with said first mating element within said elongated cavity.

16. The apparatus of claim 15, further comprising a second surface on said elongated track member within said elongated cavity, wherein said securing member comprises a removable spacer element sized to be wedged between said unitary form member and said second surface to removably secure said unitary form member to said elongated surface.

17. The apparatus of claim 1, wherein said unitary deck forming member further comprises an alignment channel formed on an outer portion of said edge forming portion, said alignment channel being adapted to be aligned with adjacent deck forming members.

18. The apparatus of claim 17, wherein said alignment channel is disposed on a pool-facing side of said unitary deck fanning element.

19. An apparatus for forming deck edging for a swimming pool, comprising:

an elongated track member having a top portion and a bottom portion with a elongated cavity defined therebetween, said top portion being adapted to have a unitary deck forming member removably mated thereto, and said elongated cavity being configured to receive an automatic pool cover guide member that guides an edge of an automatic pool cover as it is extended or retracted.

20. The apparatus of claim 19, wherein said top portion includes a bottom side, said bottom side having a recess defined therein for receiving a protrusion integrally formed on a top side of said unitary deck fanning member.

21. The apparatus of claim 19, wherein said pool covet guide member comprises a cover-guide extrusion and wherein said elongated cavity includes structure adapted to mate with said cover-guide extrusion.

22. An apparatus for forming deck edging for a swimming pool, comprising:

(a) an elongated track member configured to be permanently attached to the wall of the swimming pool, said elongated track member having a top member and a bottom member forming an open-sided cavity between said top member and said bottom member, the bottom side of said top member having a channel defined therein for receiving a pool cover guide member; and (b) a unitary metallic form element for forming an edge of the decking for the pool, the form element including a generally vertical side wall shaped to form the deck edging for the swimming pool, a bottom wall extending generally laterally from said side wall, said bottom wall being configured for insertion in said open-sided cavity, and a protrusion integrally formed on a top surface of said bottom wall, said protrusion being configured to be :received at least partially within said channel formed in said top member of said elongated track member.

23. The apparatus of claim 22, wherein said bottom wall extends generally laterally from the bottom of said generally vertical side wall.

24. The apparatus of claim 22, wherein said protrusion extends generally vertically from said top surface of said bottom wall.

25. The apparatus of claim 22, wherein said top surface of said bottom wall includes a channel adjacent to said protrusion, said channel being configured to receive a corresponding protrusion extending from the bottom of said top member of said elongated track member.

26. The apparatus of claim 25, wherein said channel on said top surface of said bottom wall is formed in between said protrusion and a step in said bottom wall.

27. The apparatus of claim 22, wherein said side wall includes an alignment channel disposed on the pool-side of said side wall.

28. An apparatus for constructing edging of a swimming pool, comprising:

(a) an elongated guide connector adapted to be permanently attached to a wall of the swimming pool and having an open-sided cavity defined therein for receiving a pool cover guide member, said connector having a top portion and a bottom portion, a bottom side of the top portion having a first form mating structure formed thereon, (b) a unitary deck forming member having an edge funning portion shaped to form the edging and a mating portion integral with the edge forming portion adapted to protrude into the cavity, and (c) a second form mating structure integrally formed on a top side of said mating portion for removably mating with the first form mating structure to thereby removably couple the top side of said mating portion of the deck forming member to the bottom side of the top portion of the elongated guide connector.

29. The apparatus of claim 8, further comprising a cover to cover said channel when said pool cover guide member is not installed therein.

* * * * *